US008152598B2

(12) United States Patent
Fukushima et al.

(10) Patent No.: US 8,152,598 B2
(45) Date of Patent: Apr. 10, 2012

(54) SUBSTRATE TREATING METHOD AND SUBSTRATE TREATING APPARATUS

(75) Inventors: Dai Fukushima, Kamakura (JP); Atsushi Shigeta, Yokkaichi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 764 days.

(21) Appl. No.: 12/266,069

(22) Filed: Nov. 6, 2008

(65) Prior Publication Data

US 2009/0124174 A1 May 14, 2009

(30) Foreign Application Priority Data

Nov. 12, 2007 (JP) ..... P2007-293083

(51) Int. Cl.
*B24B 41/00* (2006.01)

(52) U.S. Cl. ..... 451/11; 451/44; 451/168

(58) Field of Classification Search ..... 451/11, 451/41, 44, 168
See application file for complete search history.

(56) References Cited

U.S. PATENT DOCUMENTS

| | | | | |
|---|---|---|---|---|
| 5,117,590 | A * | 6/1992 | Kudo et al. | 451/44 |
| 5,514,025 | A | 5/1996 | Hasegawa et al. | |
| 6,231,429 | B1 * | 5/2001 | Lisec | 451/44 |
| 6,302,769 | B1 * | 10/2001 | Nishi et al. | 451/44 |
| 6,773,335 | B2 * | 8/2004 | Hakomori | 451/44 |
| 7,014,529 | B1 | 3/2006 | Kubota et al. | |
| 7,744,445 | B2 * | 6/2010 | Kubota et al. | 451/41 |
| 2001/0011002 | A1 * | 8/2001 | Steere, III | 451/168 |
| 2004/0000326 | A1 | 1/2004 | Ziemins et al. | |
| 2005/0250423 | A1 * | 11/2005 | Nakamura et al. | 451/41 |
| 2006/0243304 | A1 * | 11/2006 | Hsu et al. | 134/6 |
| 2008/0293336 | A1 * | 11/2008 | Zhang et al. | 451/44 |

FOREIGN PATENT DOCUMENTS

| | | |
|---|---|---|
| JP | 2006-303112 | 11/2006 |
| WO | WO 2006/112531 A1 | 10/2006 |

* cited by examiner

*Primary Examiner* — Maurina Rachuba

(74) *Attorney, Agent, or Firm* — Finnegan, Henderson, Farabow, Garrett & Dunner, L.L.P.

(57) ABSTRACT

A substrate treating method includes rotating a substrate in a circumferential direction and polishing a peripheral portion of the substrate by pressing a polishing member to it using a pressing mechanism having a pressing pad. An angle of at least a part of the pressing pad with respect to an axial direction, in which the pressing mechanism makes the pressing pad press the peripheral portion of the substrate, is changed by an angle displacement mechanism which actively displaces the angle so that the polishing is performed depending on a surface to be polished in the peripheral portion.

19 Claims, 5 Drawing Sheets

SUBSTRATE TREATING METHOD AND SUBSTRATE TREATING APPARATUS

CROSS-REFERENCE TO RELATED APPLICATIONS

This application is based upon and claims the benefit of priority from the prior Japanese Patent Application No. 2007-293083, filed on Nov. 12, 2007; the entire contents of which are incorporated herein by reference.

BACKGROUND OF THE INVENTION

1. Field of the Invention

The present invention relates to a substrate treating method and a substrate treating apparatus for polishing a peripheral portion of a substrate such as a semiconductor wafer.

2. Description of the Related Art

In recent years, along with finer structures of semiconductor elements and higher integration of semiconductor devices, it has become important to remove surface roughness which is produced at a peripheral portion (bevel portion and edge portion) of a semiconductor wafer (substrate) or a film which attaches to a peripheral portion (bevel portion and edge portion) of a substrate to cause contamination.

As techniques for the above objects, there are conventionally known methods such as a polishing method, an etching method, and a method using a microtorch. Among them, the polishing method is used extensively because its processing time is short and controllability of a treating region is relatively high. According to the polishing method, in general, a substrate is rotated in a circumferential direction, and a polishing member such as a polishing tape is pressed onto a surface of a peripheral portion of the substrate to polish it.

But, the conventional polishing technique is hard to press the polishing member effectively and appropriately onto a large area of the peripheral portion of a semiconductor wafer. Further, since the conventional polishing technique polishes a bevel portion of a semiconductor wafer, an edge portion polishing apparatus is required in addition to the bevel portion polishing apparatus in order to polish a flat surface portion (i.e. edge portion) next to the bevel portion. In such a case, the polishing mechanism and the polishing process become complex, possibly resulting in lower efficiency of polishing, a higher processing cost and a lower yield.

SUMMARY OF THE INVENTION

An aspect of the present invention relates to a substrate treating method, comprising rotating a substrate in a circumferential direction and polishing a peripheral portion of the substrate by pressing a polishing member to it using a pressing mechanism having a pressing pad, wherein an angle of at least a part of the pressing pad with respect to an axial direction, in which the pressing mechanism makes the pressing pad press the peripheral portion of the substrate, is changed by an angle displacement mechanism which actively displaces the angle so that the polishing is performed depending on a surface to be polished in the peripheral portion.

Another aspect of the present invention relates to a substrate treating apparatus for polishing a peripheral portion of a substrate, comprising a substrate holding mechanism which holds and rotates the substrate in a circumferential direction; and a pressing mechanism which is provided with a pressing pad to press the polishing member to the peripheral portion of the substrate in order to polish the peripheral portion of the substrate and an angle displacement mechanism which actively displaces an angle of at least a part of the pressing pad with respect to an axial direction, in which the pressing mechanism makes the pressing pad press the peripheral portion of the substrate.

DETAILED DESCRIPTION OF THE INVENTION

Embodiments of the present invention will be described below. The embodiments of the present invention are described with reference to the drawings, which are provided for the purpose of illustration only, and the present invention is not limited to the drawings. Although the following embodiments are all described with reference to examples using semiconductor wafers as substrates, it is needless to say that the present invention is not limited to the semiconductor wafer but can be applied extensively to various types of substrates if the peripheral portion is required to be polished.

FIRST EMBODIMENT

Figure 1:
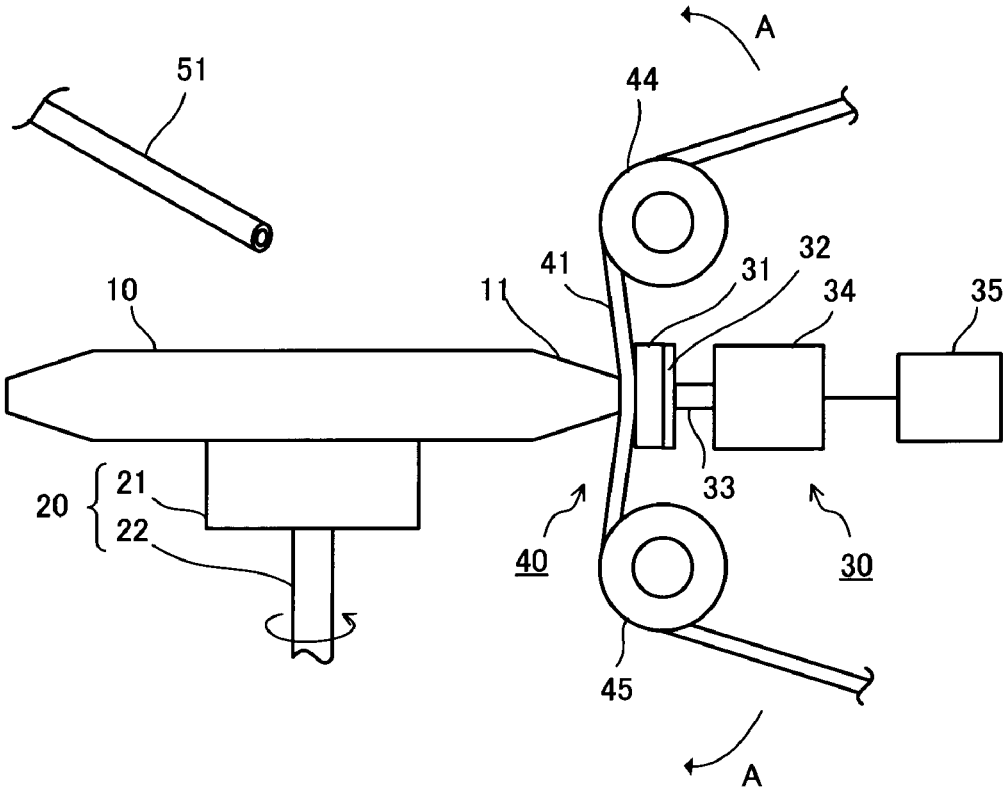
FIG. 1 is a view schematically showing an outline structure of a substrate treating apparatus according to a first embodiment.

FIG. 1 is a view schematically showing an outline structure of the substrate treating apparatus according to this embodiment when viewed from a direction parallel to a main surface of a semiconductor wafer.

Figure 2:
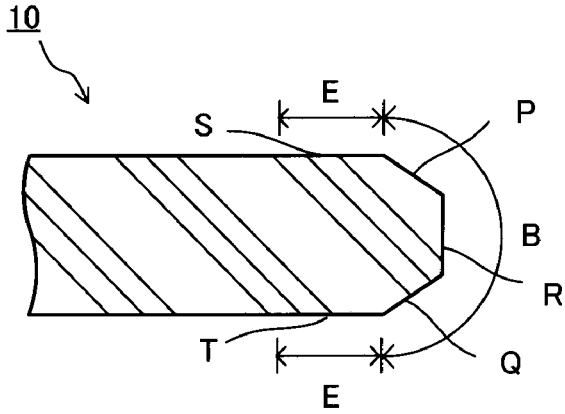
FIG. 2 is a sectional view showing a example of a peripheral portion of a semiconductor wafer.

This substrate treating apparatus polishes a peripheral portion of the semiconductor wafer having a polygonal cross section as shown in FIG. 2. A "bevel portion" indicates herein a portion (indicated by symbol B) including an upper inclined surface P, a lower inclined surface Q and an end surface R of the semiconductor wafer shown in FIG. 2, and an "edge portion" indicates flat portions (indicated by symbol E) of the front and back surfaces of the semiconductor wafer next to the "bevel portion", that is, a portion including an upper flat surface S and a lower flat surface T. Even when the "bevel portion" including the upper inclined surface P and the lower inclined surface Q or the end surface R is formed as a whole not by the flat surfaces but by a curved surface, the "bevel portion" can be polished in substantially the same manner by the present apparatus.

As shown in FIG. 1, the substrate treating apparatus of this embodiment is provided with a substrate holding mechanism 20 for holding a semiconductor wafer 10, a pressing mechanism 30 for pressing a polishing tape 41 (polishing member) against a peripheral portion 11 of the semiconductor wafer 10 to polish the peripheral portion 11 of the semiconductor wafer 10 being held by the substrate holding mechanism 20, a polishing tape supply/take-up mechanism 40 having a polishing tape supply reel and a polishing tape take-up reel (not shown either) which unreels and takes up the polishing tape 41 to and from the pressing mechanism 30, and a pure water supply nozzle 51 for supplying pure water to a part where the semiconductor wafer 10 and the polishing tape 41 are mutually contacted.

The substrate holding mechanism 20 has a holding portion 21 for holding horizontally the semiconductor wafer 10 by adsorbing it, and a rotating shaft 22 for rotating the holding portion. The semiconductor wafer 10 being held by the holding portion 21 can be rotated around the rotating shaft 22 by rotating the holding portion 21 around the rotating shaft 22.

The pressing mechanism 30 has a pressing pad 31 which is formed of an elastic material such as silicone rubber, natural rubber, urethane rubber or butylene rubber and has a pressing surface for pressing the polishing tape 41 against the peripheral portion 11 of the semiconductor wafer 10; a pressing plate 32 which is formed of metal such as stainless steel or plastic such as a vinyl chloride resin and contacted to the back surface of the pressing pad 31; a pressing head 34 which has plural linear actuators 33 for pressing the pressing plate 32 against the pressing pad 31; and a controller 35 for controlling displacement amounts of the linear actuators 33. The linear actuators 33 are provided at each positions corresponding to both ends of the pressing plate 32 in the horizontal direction (i.e. direction parallel to the front surface of the semiconductor wafer 10), such that the pressing plate 32 is curved in the horizontal direction depending on the displacement amounts of the linear actuators 33. The linear actuators 33 are driven to curve the pressing plate 32, so that the surface of the pressing pad 31 which works as the pressing surface of the polishing tape 41 is deformed at almost the same curvature as the pressing plate 32, and therefore, the polishing tape 41 is pressed against the peripheral portion of the semiconductor wafer 10 as a result of being deformed at almost the same curvature as the pressing plate 32. In other words, the linear actuators 33 function as means for changing the whole shape of the pressing pad 31 to nearly the same shape of the surface to be polished by means of changing the angle of at least a part of the pressing pad 31, which presses the polishing tape 41, with respect to an axial direction, in which the pressing mechanism 30 (or pressing head 34) makes the pressing pad 31 press the peripheral portion 11 of the semiconductor wafer 10. The number and positions of the linear actuators 33 are not particularly limited as long as the pressing plate 32 can be curved at a desired curvature in the horizontal direction. It is also possible to use a flexural displacement actuator, which is used in a third embodiment described later, instead of the linear actuators 33.

The polishing tape supply/take-up mechanism 40 has a pair of guide rollers 44, 45 in addition to the polishing tape supply reel and the polishing tape take-up reel, to guide the polishing tape 41 unreeled from the polishing tape supply reel to the surface of the pressing pad 31 of the pressing mechanism 30 and further to guide from the surface of the pressing pad 31 to the polishing tape take-up reel.

The pair of guide rollers 44, 45 are configured to move together with the pressing pad 31, the pressing plate 32, the linear actuator 33 and the pressing head 34 of the pressing mechanism 30 back and forth relative to the peripheral portion 11 of the semiconductor wafer 10 and to rotate up and down in a direction (indicated by arrow A in FIG. 1) perpendicular to the surface of the semiconductor wafer 10. At this point, the pressing mechanism 30 and the polishing tape supply/take-up mechanism 40 are moved such that a surface of the polishing tape 41 opposed to the surface to be polished, which is determined by the pair of guide rollers 44, 45, maintains the relation nearly perpendicular to the axial direction of the pressing mechanism 30 (or pressing pad 31), i.e. the pressing direction of the pressing pad 31.

Next, a substrate treating method is described below, which uses the substrate treating apparatus configured as described above. First, the semiconductor wafer 10 is held by the holding portion 21 of the substrate holding mechanism 20 as shown in FIG. 1 and rotated, for example, at 500 rpm. Then, the polishing tape 41 is continuously unreeled at a speed of, for example, 100 mm/min from the polishing tape supply reel by the polishing tape supply/take-up mechanism 40, and the unreeled polishing tape 41 is pressed by the pressing mechanism 30 against the peripheral portion 11 of the semiconductor wafer 10 to polish it in order of, for example, the upper inclined surface P, the end surface R and the lower inclined surface Q.

At the same time, while pure water is supplied from the pure water supply nozzle 51 to a part where the polishing tape 41 and the semiconductor wafer 10 are mutually contacted, the displacement amounts of the linear actuators 33 are controlled in accordance with the curvature of the surface to be polished (upper inclined surface P, end surface R and lower inclined surface Q). In other words, the linear actuators 33 are operated such that the surface of the pressing pad 31 for pressing the polishing tape 41 has almost the same curvature as the surface to be polished.

Figure 3A:
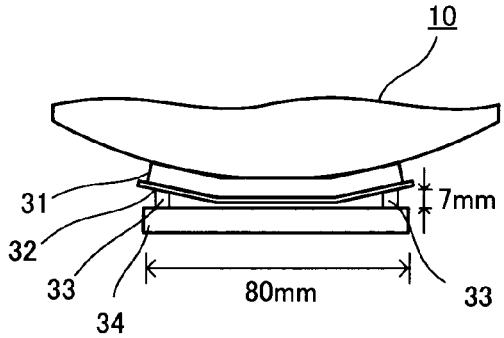
FIGS. 3A and 3B are views illustrating a substrate treating method according to the first embodiment.
Figure 3B:
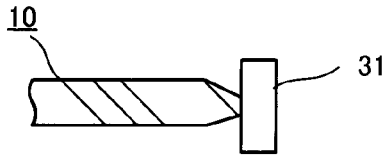
Figure 4A:
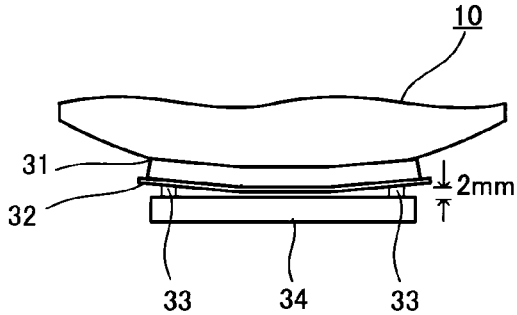
FIGS. 4A and 4B are views illustrating a substrate treating method according to the first embodiment.
Figure 4B:
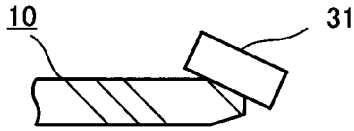

FIGS. 3A, 3B, 4A and 4B show an example of the above operation. FIGS. 3A and 3B are views schematically showing a state that the polishing tape 41 is pressed to the end surface R of the peripheral portion 11 of the semiconductor wafer 10 (a diameter of 300 mm, an inclination angle of +70° of the upper inclined surface P relative to the end surface R, an inclination angle of −70° of the lower inclined surface Q relative to the end surface R) by the pressing pad (a length of about 80 mm in a transverse direction) 31 and the pressing plate 32. FIGS. 4A and 4B are views schematically showing a state that the polishing tape 41 is pressed to the upper inclined surface P (or lower inclined surface Q) of the peripheral portion 11 of the same semiconductor wafer 10. FIGS. 3A and 4A are views from a direction perpendicular to the surface of the semiconductor wafer 10, and FIG. 3B and FIG. 4B are views from a direction parallel to the surface of the semiconductor wafer 10. FIGS. 3B and 4B show the semiconductor wafer 10 and the pressing pad 31 only.

As shown in FIGS. 3A and 3B, when the polishing tape 41 is pressed to the end surface R of the peripheral portion 11 of the semiconductor wafer 10, the linear actuators 33 are displaced by about 7 mm. As shown also in FIGS. 4A and 4B, when the polishing tape 41 is pressed to the upper inclined surface P (or lower inclined surface Q) of the peripheral portion 11 of the semiconductor wafer 10, the linear actuators 33 are displaced by about 2 mm. Thus, when the linear actuators 33 are displaced, the surface of the pressing pad 31 is changed to a curved surface having almost the same curvature as that in the circumferential direction of the end surface R or the upper inclined surface P (or lower inclined surface Q) of the semiconductor wafer 10. As a result, it becomes possible to press the whole area of the polishing tape 41 to the surface of the semiconductor wafer 10, i.e. end surface R, upper inclined surface P or lower inclined surface Q, by almost an even pressure, and each of the surfaces can be polished efficiently and finely.

The polishing tape 41 includes, for example, a polyethylene terephthalate substrate (e.g., a width of 80 mm, a thickness of 50 μm) onto which diamond abrasive grains are adhered with a binder.

When polishing was conducted on the bevel portion of the semiconductor wafer 10 (a diameter of 300 mm, an inclination angle of +70° of the upper inclined surface P, an inclination angle of −70° of the lower inclined surface Q) in order of the upper inclined surface P, the end surface R and the lower inclined surface Q using an apparatus configured in the same manner as that of this embodiment, except that the linear actuators 33 and the controller 35 for controlling their displacement amounts are not provided, it took 35 seconds, 50 seconds and 35 seconds respectively, resulting in a total of 120 seconds to polish them. Meanwhile, when the same polishing was performed by applying this embodiment, the polishing could be completed in 30 seconds, 30 seconds and 30 seconds respectively resulting in a total of 90 seconds. A maximum valley height (Rv) and an average roughness (Ra) of the polished surface were measured by an optical interference measuring device WYKO NT1100 (trade name, manufactured by Veeco). The RV was 500 nm according to the former apparatus while it was 100 nm in this embodiment, leading to confirmation that polishing marks were made to have a uniform depth. It is considered that the results above may be attributed to a uniformed polishing pressure loaded on the end surface R and the inclined surfaces P, Q. There was not a large difference in the Ra between the former apparatus and this embodiment.

As described above, since this embodiment enables the curvature of the surface (i.e. surface of the pressing pad 31) which presses the polishing tape to vary to be substantially the same as the curvature of the surface to be polished, not only the end surface but also the upper and lower inclined surfaces of the bevel portion in peripheral portion of the semiconductor wafer can be polished by using almost the entire area of the polishing tape and also applying an appropriate pressure. Therefore, it is possible to improve polishing efficiency substantially, to reduce polishing time and polishing cost and to improve the quality of the polished surface in comparison with the prior art.

SECOND EMBODIMENT

A structure of the substrate treating apparatus and a polishing method are basically the same as in the first embodiment described above, so that what is described in the first embodiment is omitted.

Figure 5:
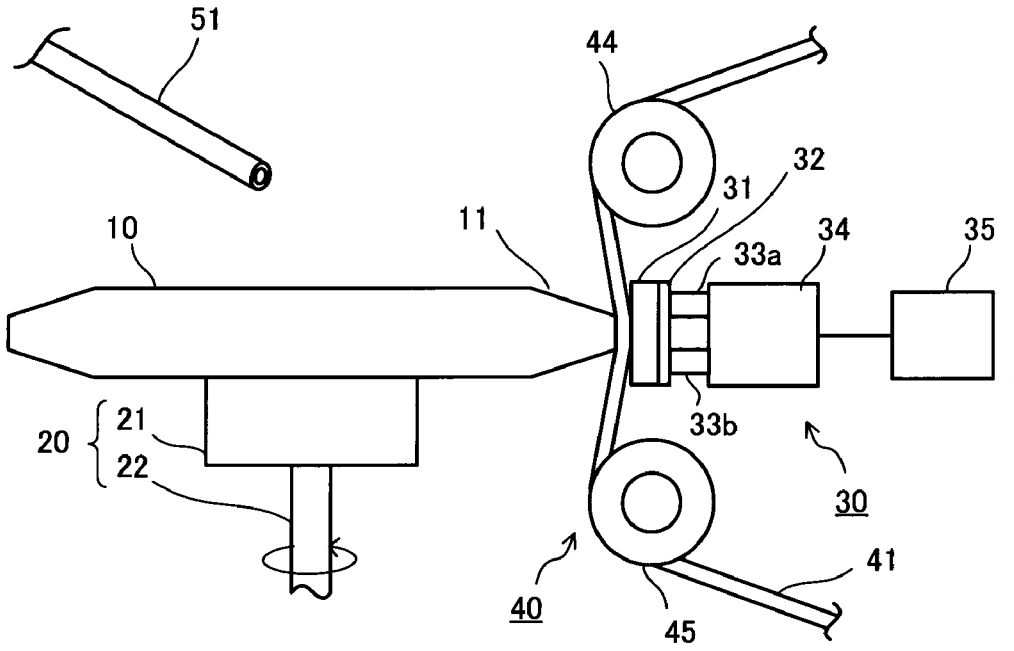
FIG. 5 is a view schematically showing an outline structure of a substrate treating apparatus according to a second embodiment.

FIG. 5 is a view schematically showing an outline structure of the substrate treating apparatus according to the second embodiment when viewed from a direction parallel to the main surface of the semiconductor wafer.

The structure of the pressing mechanism 30 of this embodiment is partly different from the first embodiment. In this embodiment, the linear actuators 33 are disposed one each at positions corresponding to both ends of the pressing plate 32 in a vertical direction (i.e. direction perpendicular to the surface of the semiconductor wafer 10) so that an inclination in the vertical direction relative to pressing direction can be applied to the pressing plate 32 in accordance with the displacement amounts of the linear actuators 33. The number and positions of the linear actuators 33 are not particularly limited as long as the inclination of the pressing plate 32 in the vertical direction can be changed to a desired angle. It is also possible to use a flexural displacement actuator, which is used in a third embodiment described later, instead of the linear actuators 33.

Figure 6:
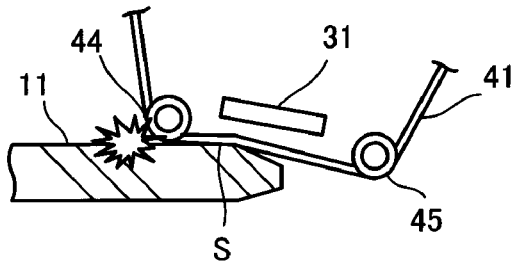
FIG. 6 is a view illustrating an effect of the substrate treating apparatus according to the second embodiment.

For the conventional apparatus, when pressing pad 31 begins to turn with a pair of guide rollers 44, 45 to a position where it can be pressed to the edge portion (upper flat surface S) to polish the edge portion (upper flat surface S) of the semiconductor wafer 10 shown, for example, in FIG. 6, the guide roller 44 comes into contact with the surface of the semiconductor wafer 10 at a turning angle (i.e. angle of the surface of the pressing pad 31 relative to the end surface R of the semiconductor wafer 10) of, for example, +82° before the pressing pad 31 reaches the position, making it impossible to polish the edge portion (upper flat surface S) by pressing the polishing tape 41 by the pressing pad 31.

Figure 7A:
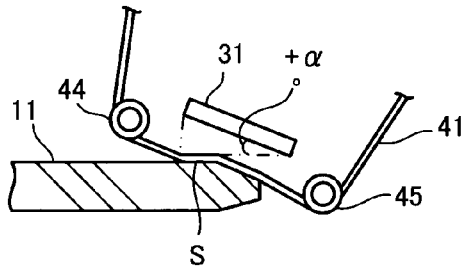
FIGS. 7A and 7B are views illustrating an effect of the substrate treating apparatus according to the second embodiment.
Figure 7B:
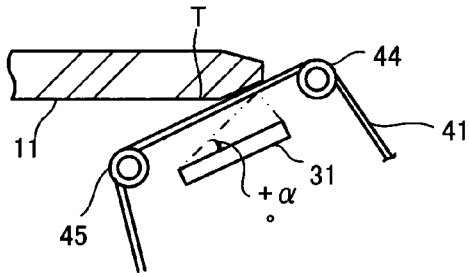

In this case, if the surface of the pressing pad 31 is formed to have an inclined surface at +α° (e.g., +10°) as shown in, for example, FIG. 7A, so that it becomes possible to polish the edge portion (upper flat surface S) by pressing the polishing tape 41 to it by the pressing pad 31 before the guide roller 44 is contacted to the surface of the semiconductor wafer 10. But, when the pressing mechanism and the polishing tape supply/take-up mechanism are turned in an opposite direction as shown in FIG. 7B, it becomes harder to polish the edge portion (lower flat surface T).

Figure 8A:
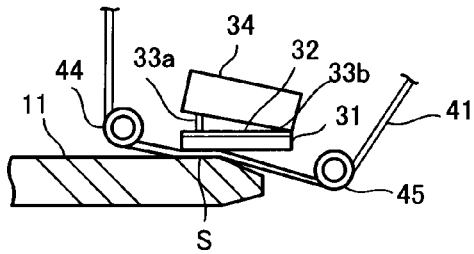
FIGS. 8A and 8B are views illustrating a substrate treating method according to the second embodiment.
Figure 8B:
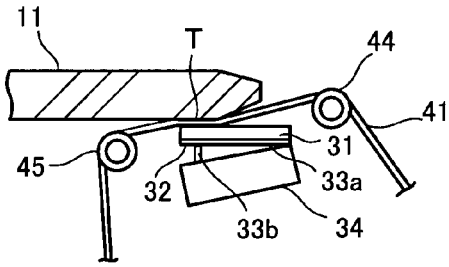

In this embodiment, the linear actuator 33 is provided at each end of the pressing plate 32 in the vertical direction as described above, so that the inclination angle in the vertical direction relative to the pressing direction of the pressing plate 32 can be adjusted in accordance with the displacement amounts of the linear actuators 33. Therefore, as shown in FIGS. 8A and 8B, it becomes possible to press the polishing tape 41 to the edge portion (upper flat surface S and lower flat surface T) of the semiconductor wafer 10 before the guide roller 44 or the guide roller 45 is contacted to the front or rear surface of the semiconductor wafer 10, that is, without being sterically restricted by them. Specifically, to polish the upper flat surface S of the peripheral portion 11 of the semiconductor wafer 10, a displacement amount of an upper actuator 33*a* may be made larger than that of a lower actuator 33*b*, so that an inclination angle (relative to the end surface R) of, for example, +α° can be applied to the surface of the pressing pad 31 as shown in FIG. 8A. Similarly, to polish the lower flat surface T of the semiconductor wafer 10, a displacement amount of the lower actuator 33*b* may be made larger than that of the upper actuator 33*a*, so that an inclination angle (relative to the end surface R) of −α° can be applied to the surface of the pressing pad 31 as shown in FIG. 8B. Thus, the polishing tape 41 can be surely pressed to both the upper flat surface S and the lower flat surface T of the semiconductor wafer 10 by the pressing pad 31 to perform polishing.

A substrate treating method using the substrate treating apparatus configured as above is described below. First, the semiconductor wafer 10 is held by the holding portion 21 of the substrate holding mechanism 20 as shown in FIG. 5 and rotated at, for example, 500 rpm. Then the polishing tape 41 is continuously unreeled at a speed of, for example, 100 mm/min from the polishing tape supply reel driven by the polishing tape supply/take-up mechanism 40. And the unreeled polishing tape 41 is pressed to the peripheral portion of the semiconductor wafer by the pressing mechanism 30 to polish it in order of, for example, the upper flat surface S, the upper inclined surface P, the end surface R, the lower inclined surface Q and the lower flat surface T.

During processing, pure water is supplied from the pure water supply nozzle 51 to a part where the polishing tape 41 and the semiconductor wafer 10 are mutually contacted, and the displacement amounts of the linear actuators 33 are controlled depending on the surfaces to be polished (upper flat surface S, upper inclined surface P, end surface R, lower inclined surface Q and lower flat surface T).

Specifically, in order to polish the upper flat surface S, for example, the pressing pad 31 (length of about 20 mm in a longitudinal direction) is turned together with the pair of guide rollers 44, 45 to a position where the guide roller 44 is not contacted to the surface of the semiconductor wafer 10 (a diameter of 300 mm, an inclination angle of +70° of the upper inclined surface P, an inclination angle of −70° of the lower inclined surface Q), for example, to a position where the surface of the pressing pad 31 has an angle of +70° relative to the end surface R, then the upper linear actuator 33*a* is extended by about 3 mm. Thus, the angle of the surface of the pressing pad 31 relative to the end surface R is increased by about +25°, the surface of the pressing pad 31 becomes substantially parallel to the upper flat surface S, and the polishing tape 41 can be pressed to the entire upper flat surface S to polish it. In a case where the lower flat surface T is polished, contrary to the case of polishing the upper flat surface S, the pressing pad 31 is turned together with the pair of guide rollers 44, 45 to a position where the guide roller 44 is not contacted to the surface of the semiconductor wafer 10, for example, to a position where the surface of the pressing pad 31 has an angle of −70° relative to the end surface R, then the lower linear actuator 33*b* is extended by about 3 mm. Thus, the angle of the surface of the pressing pad relative to the end surface R is increased by about −25°, the surface of the pressing pad 31 becomes substantially parallel to the lower flat surface T, and the polishing tape 41 can be pressed to the entire lower flat surface T to polish it. The upper inclined surface P, the end surface R and the lower inclined surface Q may be polished without operating the linear actuators 33*a*, 33*b* because the surface of the pressing pad 31 can be made parallel to the surfaces to be polished by a turning operation only.

For the polishing tape 41 this embodiment can also use, for example, a polyethylene terephthalate substrate (e.g., width of 80 mm, thickness of 50 μm) onto which diamond abrasive grains are adhered with a binder, as used in the first embodiment.

As described above, since an angle relative to the vertical direction of the surface of the pressing pad 31 can be displaced relative to the pressing direction of the pressing pad 31 in this embodiment, the polishing tape 41 can be pressed to not only the bevel portion of the semiconductor wafer 10 but also the edge portion without being sterically restricted by the guide rollers 44, 45 to polish them.

Similar to the first embodiment, this embodiment may be configured so as to curve the pressing plate 32 in a transverse direction by the operation of the linear actuators. Thus, in addition to the above-described effects, the bevel portion can be polished similar to the first embodiment by using substantially the entire area of the polishing tape and applying an appropriate pressure to not only the end surface but also the upper and lower inclined surfaces. Besides, it is possible to reduce polishing time and polishing cost and to improve the quality of polished surface. In this case, the linear actuators for adjusting an vertical angle of pressing plate 32 relative to a pressing direction can also be used as a part or all of the linear actuators for curving the pressing plate 32 in a transverse direction.

THIRD EMBODIMENT

Since a structure of the substrate treating apparatus and a polishing method in this embodiment are basically the same as in the above-described first and second embodiments, what is described in the first embodiment or the second embodiment is omitted.

Figure 9:
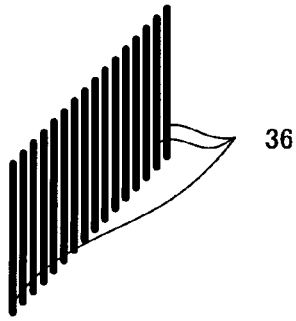
FIG. 9 is a view showing the structure of a main portion of a substrate treating apparatus according to a third embodiment.

In this embodiment, the structure of the pressing mechanism 30 is different from the first and second embodiments. FIG. 9 schematically shows the structure of its main portion.

As shown in FIG. 9, instead of the pressing plate 32 and the linear actuators 33, this embodiment uses plural, for example, 16 flexural displacement actuators 36, which are, for example, cylindrical with a diameter of 5 mm and a length of 20 mm. They can make a flexural displacement at a curvature radius of 2 mm and at any angle of, for example, 0 to 100° relative to a direction perpendicular to their longitudinal direction and are arranged parallel in a plane on the back surface of the pressing pad (not shown) with their bending directions aligned.

In this embodiment displacement amounts of the plural flexural displacement actuators 36 can be respectively controlled by the controller 35 to change the entire shape of the pressing pad into substantially the same shape as the surface to be polished, depending on the surface of the peripheral portion 11, which makes it possible to polish effectively the peripheral portion 11 of the semiconductor wafer 10.

Figure 10A:
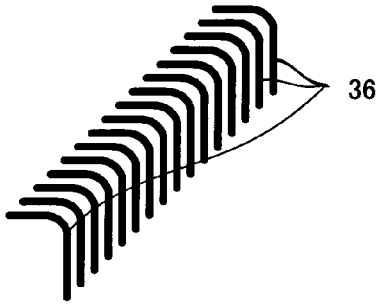
FIGS. 10A to 10C are views illustrating a substrate treating method according to the third embodiment.
Figure 10B:
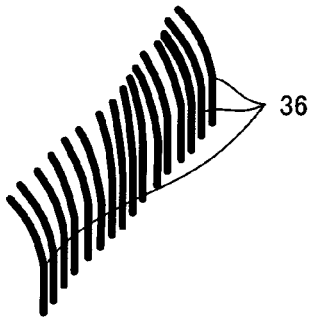
Figure 10C:
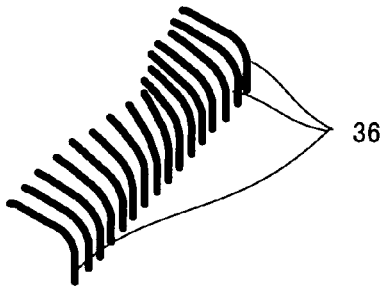

For example, when the plural flexural displacement actuators 36 are bent at an angle of +90° as shown in FIG. 10A, the polishing tape 41 can be pressed to and polish the upper flat surface S of the semiconductor wafer 10, or the upper flat surface S and the end surface R. In this case, when the bending angle is set to an angle corresponding to the upper inclined surface P, the polishing tape 41 can be pressed to and polish the upper inclined surface P of the semiconductor wafer 10, or the upper inclined surface P and the end surface R. When the displacement amounts of the individual flexural displacement actuators 36 are controlled such that a curvature in a transverse direction of the pressing pad surface becomes substantially the same as that of the upper inclined surface P, followability of the polishing tape 41 for the circumferential direction of the upper inclined surface P is improved, and it becomes possible to polish more efficiently. Specifically, when the displacement amounts of the flexural displacement actuators 36 which are positioned at the center are set to be slightly smaller than those positioned outside as shown in, for example, FIGS. 10B and 10C, the followability of the polishing tape 41 for the circumferential direction of the upper inclined surface P is improved, the use region of the polishing tape 41 is increased, and it becomes possible to polish much more efficiently. FIG. 10B shows an example of the displacement of the flexural displacement actuators 36 when the upper inclined surface P with an inclination angle of about 20° is polished, and FIG. 10C is an example of the displacement of the flexural displacement actuators 36 when the upper inclined surface P with an inclination angle of about 70° is polished.

According to this embodiment, the means for integrally turning the pressing pad 31 together with the pair of guide rollers 44, 45 relative to the peripheral portion 11 of the semiconductor wafer 10 according to the first and second embodiments can be eliminated, and the apparatus can be simplified and downsized.

Although the present invention has been described above by reference to the embodiments of the invention, the invention is not limited to the embodiments described above. It is to be understood that modifications and variations of the embodiments can be made without departing from the spirit and scope of the invention. For example, the polishing tape is used as the polishing member in the embodiments described above, but it is also possible to use a fixed-abrasive pad, which is fixed at a predetermined position, instead of the polishing tape. One which has ceria abrasive grains buried in an elastic resin can be used as the fixed-abrasive pad. Such fixed-abrasive pad is fixed to the surface of the pressing pad 31.

What is claimed is:

1. A substrate treating method, comprising:

rotating a substrate in a circumferential direction and polishing a peripheral portion of the substrate by pressing a polishing member to it using a pressing mechanism having a pressing pad and a pressing plate disposed on the rear surface of the pressing pad, wherein an angle of at least a part of the pressing pad with respect to an axial direction, in which the pressing mechanism makes the pressing pad press the peripheral portion of the substrate, is changed by an angle displacement mechanism so that the polishing is performed depending on a surface to be polished in the peripheral portion, and the angle displacement mechanism actively displaces the angle by deforming the pressing plate.

2. The substrate treating method according to claim 1, wherein the angle displacement mechanism has a plurality of actuators, and displacement amounts of the individual actuators are controlled to change the angle of the pressing pad with respect to the axial direction.

3. The substrate treating method according to claim 2, wherein the actuators are linear actuators.

4. The substrate treating method according to claim 2, wherein the actuators are flexural displacement actuators.

5. The substrate treating method according to claim 1, wherein an angle of at least a part of the pressing pad with respect to a direction parallel to the surface of the substrate is varied by the angle displacement mechanism.

6. The substrate treating method according to claim 1, wherein an angle of at least a part of the pressing pad with respect to a direction perpendicular to the surface of the substrate is varied by the angle displacement mechanism.

7. The substrate treating method according to claim 1, wherein angles of at least a part of the pressing pad with respect to a direction perpendicular to the surface of the substrate and a direction parallel to the surface of the substrate are varied by the angle displacement mechanism.

8. The substrate treating method according to claim 1, wherein at least a part of the pressing pad is varied by the angle displacement mechanism to have substantially the same shape as or to be substantially parallel to the surface to be polished.

9. The substrate treating method according to claim 1, wherein the peripheral portion of the substrate has first and second surfaces with an angle therebetween, and the pressing pad is turned together with the polishing member in a direction perpendicular to the surface of the substrate to press the first and second surfaces from different directions.

10. The substrate treating method according to claim 1, wherein the peripheral portion of the substrate has first and second surfaces with an angle therebetween, and the pressing pad is pressed to the first and second surfaces from one direction.

11. The substrate treating method according to claim 1, wherein the substrate peripheral portion includes a bevel portion and an edge portion.

12. A substrate treating apparatus for polishing a peripheral portion of a substrate, comprising:

a substrate holding mechanism which holds and rotates the substrate in a circumferential direction; and a pressing mechanism including a pressing pad to press a polishing member to the peripheral portion of the substrate in order to polish the peripheral portion of the substrate and an angle displacement mechanism having a plurality of actuators and a controller controlling displacement amounts of the individual actuators, the angle displacement mechanism actively displacing an angle of at least a part of the pressing pad with respective to an axial direction, in which the pressing mechanism makes the pressing pad press the peripheral portion of the substrate.

13. The substrate treating apparatus according to claim 12, wherein the pressing mechanism has a pressing plate which is provided on the back surface of the pressing pad.

14. The substrate treating apparatus according to claim 12, wherein the pressing pad and the polishing member are integrally configured to move back and forth relative to the peripheral portion of the substrate.

15. The substrate treating apparatus according to claim 14, wherein the pressing pad and the polishing member are integrally configured to rotate up and down in a direction perpendicular to a surface of the substrate.

16. The substrate treating apparatus according to claim 12, wherein the plurality of actuators comprise a plurality of flexural displacement actuators arranged parallel in a plane on the back surface of the pressing pad.

17. The substrate treating apparatus according to claim 12, wherein the polishing member is a polishing tape.

18. The substrate treating apparatus according to claim 17, further comprising a polishing tape supply/take-up mechanism which has guide rollers for guiding the polishing tape to a surface of the pressing pad.

19. A substrate treating method, comprising:

rotating a substrate in a circumferential direction and polishing a peripheral portion of the substrate by pressing a polishing member to it using a pressing mechanism having a pressing pad, wherein an angle of at least a part of the pressing pad with respect to an axial direction, in which the pressing mechanism makes the pressing pad press the peripheral portion of the substrate, is changed by an angle displacement mechanism so that the polishing is performed depending on a surface to be polished in the peripheral portion, the angle displacement mechanism has a plurality of actuators, and displacement amounts of the individual actuators are controlled to change the angle, and the actuators are linear actuators or flexural displacement actuators.

* * * * *